United States Patent [19]

Hudgens

[11] Patent Number: 4,560,897

[45] Date of Patent: Dec. 24, 1985

[54] RIGID INDENTED CYLINDRICAL CATHODE FOR X-RAY TUBE

[75] Inventor: Claude R. Hudgens, Dayton, Ohio

[73] Assignee: The United States of America as represented by the Department of Energy, Washington, D.C.

[21] Appl. No.: 501,312

[22] Filed: Jun. 6, 1983

[51] Int. Cl.[4] ..... H01J 1/20

[52] U.S. Cl. ..... 313/337; 313/340; 313/341; 313/356

[58] Field of Search ..... 313/337, 341, 356, 340; 378/122, 136

[56] References Cited

U.S. PATENT DOCUMENTS

| | | | |
|---|---|---|---|
| 2,455,287 | 11/1948 | Allen, Jr. | 313/337 |
| 2,558,461 | 6/1951 | Rajchman | 313/337 |
| 2,875,367 | 2/1959 | Beggs | 313/337 |
| 2,887,607 | 5/1959 | Millis | 313/337 |
| 2,932,759 | 4/1960 | Shepherd | 313/337 |
| 3,265,924 | 8/1966 | Baker | 313/337 |
| 3,506,871 | 4/1970 | Hunt | 313/337 |
| 3,745,342 | 7/1973 | Le Poole | 313/337 |
| 4,065,690 | 12/1977 | Maeyama | 313/57 |
| 4,100,449 | 7/1978 | Gange | 313/57 |
| 4,159,436 | 6/1979 | Ely | 313/57 |

*Primary Examiner*—William F. Smith

*Attorney, Agent, or Firm*—George H. Libman; Albert Sopp; Judson R. Hightower

[57] ABSTRACT

A cathode assembly for a vacuum tube includes a wire filament, a straight tubular anode parallel to and surrounding the wire filament, and insulating spacers for rigidly fastening the filament with respect to the anode, and with one side of the anode indented or flattened such that only one portion of the anode is heated to emitting temperatures by the filament.

12 Claims, 6 Drawing Figures

RIGID INDENTED CYLINDRICAL CATHODE FOR X-RAY TUBE

The U.S. Government has rights in this invention pursuant to Contract No. DE-AC04-76-DP00053 between the Department of Energy and Monsanto Research Corportion.

BACKGROUND OF THE INVENTION

The present invention relates generally to a removable cathode for an X-ray tube and more particularly to an indented cylindrical cathode having improved rigidity and a well-defined electron-emitting area.

The interchangeable cathode X-ray tube has been in use for nearly 50 years. The advantage of this tube is that the most fragile part, the cathode, may be replaced as it burns out without the expense of replacing the entire tube. However, these tubes have historically suffered from the disadvantage that the replaceable cathode must be very accurately aligned in order for the tube to achieve desired performance capabilities. This type of tube went out of favor when the cost of downtime due to alignment exceeded the cost of replacing the entire tube.

To overcome this disadvantage, this invention provides a rigid replaceable cathode for an X-ray tube which is designed to be firmly clamped into a prealigned holder in the X-ray tube.

A couple of prior patents have used structure which is superficially similar to that of the invention, although it does not and cannot perform the same function. U.S. Pat. No. 3,745,342 of Jan Le Poole shows a cathode assembly for an electron microscope utilizing a filament under tension which passes across two spaced V-blocks and through a cylindrical anode situated between the blocks. This patent relies on tension on the wire for mechanical stability and the use of grids in controlled potentials for bombardment heating of the wire. This structure does not have the required mechanical stability to allow easy, alignment-free replacement in an X-ray tube, nor does it have the necessary high-power capability necessary for X-ray tubes.

U.S. Pat. No. 4,100,449 of Robert Gange has a cylindrical filament which is substantially uniform in cross section about its longitudinal axis. While the physical construction of this low-power display cathode does provide mechanical strength as does this invention, Gange's invention lacks the unique thermodynamic and mechanical properties which enable it to be used for high-power X-ray applications.

SUMMARY OF THE INVENTION

It is an object of this invention to provide a high-power, easily installed efficient cathode assembly for vacuum tubes.

It is another object of this invention to provide an electron beam-heated cathode which does not require extensive alignment in a tube.

It is a further object of this invention to provide a long-lived, mechanically stable cathode that will require infrequent replacement.

Additional objects, advantages and novel features of the invention will become apparent to those skilled in the art upon examination of the following description or may be learned by practice of the invention. The objects and the advantages of the invention may be realized and attained by means of the instrumentalities and combinations particularly pointed out in the appended claims.

To achieve the foregoing and other objects and in accordance with the purpose of the present invention, as embodied and broadly described herein, the cathode asembly of this invention may comprise a wire filament having a straight portion, a straight tubular cathode parallel to and surrounding only the straight portion of the filament and having an inside cross-sectional diameter at least ten times the diameter of the filament, and insulating spacers for rigidly fastening the filament with respect to the cathode, such that the minimum distance between the filament and the cathode over only one sector of the cathode is less than 35% of the diameter of the cathode. The cathode assembly further comprises a V-block mount for positively and accurately mounting the rigid cathodes in a vacuum tube.

BRIEF DESCRIPTION OF THE DRAWINGS

The accompanying drawings, which are incorporated in and form a part of the specification, illustrate an embodiment of the present invention and, together with the description, serve to explain the principles of the invention.

DETAILED DESCRIPTION OF THE INVENTION

Figure 1:
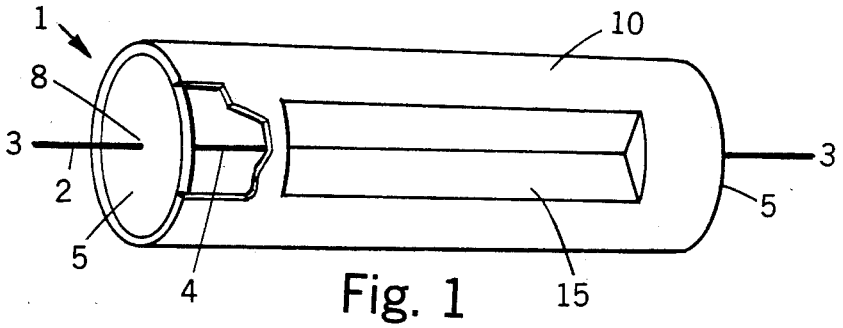
FIG. 1 is a partially cut-away perspective view of a cathode assembly in accordance with a first embodiment of the invention.

As shown in FIG. 1, in accordance with a first embodiment of this invention, a cathode assembly 1 includes a wire filament 2 of maximum cross-sectional diameter W, having opposing ends 3 for connection to a source of electrical power and, between ends 3, a straight portion 4. A straight tubular cathode 10 is arranged parallel to and surrounding only the straight portion 4 of filament 2. In accordance with the invention, cathode 10 has a normal inside cross-sectional diameter C at least ten times greater than W. At least a pair of insulating spacers 5 rigidly fasten cathode 10 with respect to filament 2 such that the minimum distance D between filament 2 and cathode 10 is less than 35% of C minus 50% of W; i.e., $D<(0.35C-0.5W)$.

In the embodiment of FIG. 1, cathode 10 is a right cylinder having a cross-section which is circular at the ends and which includes an indented portion 15 over most of its length. A ceramic spacer 5 at each end of cathode 10 has a circular diameter conforming to the inside diameter of cathode 10 and a hole 8 in the center for the passage of wire filament 2. In operation, when filament 2 is heated to a sufficient temperature and maintained at a sufficient negative potential with respect to cathode 10, a current-emitting area which is approximately an image of the indented section is generated. Electrons tend to flow from the heated filament 2 to the nearest surface of lower potential, which in this case is the tip of the indented section. This portion of cathode 10 then radiates electrons to the X-ray tube.

One advantage of this construction over a uniformly heated cathode which does not include the minimum spacing to the indented portion of this invention is that the invention requires only that the indented portion of a cathode be heated whereas a uniformly heated cathode requires that the entire cathode be heated. In other words, this invention is more efficient than a uniformly heated cathode. An additional advantage is that the electron-emitting indented portion of the cylinder is mechanically supported by the adjacent cooler cylinder material, by which means superior mechanical and dimensional stability is achieved.

Indented portion 15 may be pressed, stamped, or welded into the side of cathode 10 as shown in the embodiment of FIG. 1. Alternatively, other forms are available to provide the required relationship between C, W, and D.

Figure 2:
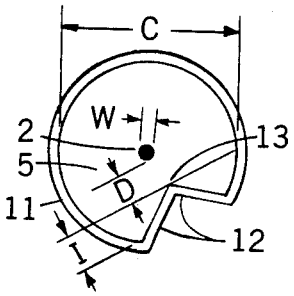
FIG. 2 is an end view of a second embodiment of the invention.

FIG. 2 shows an end view of a second embodiment of the invention wherein cathode 10 has an arcuate portion 11 surrounding most of its circumference (and defining a remaining sector of the circumference) and two straight portions 12 connecting the ends of arcuate portion 11 (which defines a first sector of the circumference). Straight portions 12 join at intersection 13, which intersection is the closest distance to filament 2.

Figure 3:
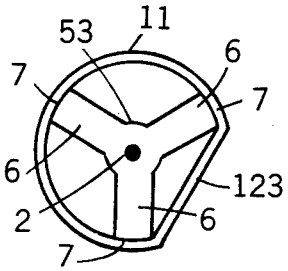
FIG. 3 is an end view of a third embodiment of the invention.

Another embodiment is shown in FIG. 3, where arcuate portion 11 is substantially circular as before and the ends of arcuate portion 11 are connected by a single straight portion 123. Spacer 53 still maintains filament 2 in the center of cathode 10; however, spacer 53 now has a plurality of spokes 6 making contact at at least two points 7 on the inside of cathode 10. Since this device is utilized in an evacuated X-ray tube, it is of no operational significance whether the assembly is evacuated and sealed or whether the ends of space 5 are open.

Figure 4:
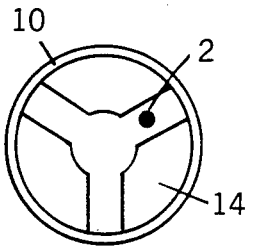
FIG. 4 is an end view of a fourth embodiment of the invention.

Another embodiment is shown in FIG. 4, where cathode 10 comprises a right circular cylinder and filament 2 is affixed therein at an out-of-center position, spaced the proper distance D from cathode 10. As in the previous embodiment, inside 14 is open to the vacuum of the X-ray tube.

Figure 5:
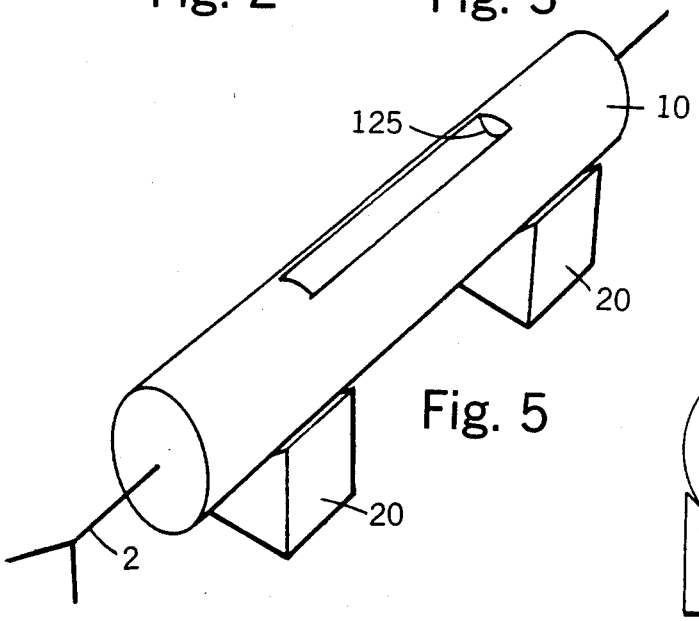
FIG. 5 is a perspective view of another embodiment of the invention mounted in an X-ray tube.
Figure 6:
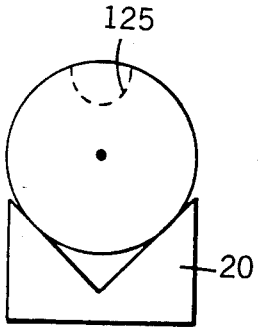
FIG. 6 is an end view of the embodiment of FIG. 5.

FIGS. 5 and 6 show another embodiment wherein the indented portion 125 has an arcuate cross-section. Cathode 10 is mounted to two V-blocks 20 by a spring or a set-screw and the blocks are mountable within an X-ray tube.

As previously stated, the operation of this device requires filament 2 to be near a first sector of cathode 10, in order that the cathode may be heated at a relatively small distance of its circumference along its entire length by electrons flowing from the filament to this near surface. A cathode diameter at least 10 times greater than the filament diameter is believed to be a necessary requirement for the operation of this device, as a larger diameter filament would heat too much of the remaining sector of the circumference of the cathode. However, a cathode diameter of approximately 20 times the filament diameter should give better performance.

For a round cathode 10 having filament 2 centered as shown in FIGS. 1, 2, 3, 5 and 6, indent $I \geqq 0.2C$; and preferably, $I \simeq 0.25C$.

A typical cathode assembly in accordance with FIG. 1 would have a tungsten cathode 2 cm long, having an outside diameter of approximately 3 millimeters, a normal inside diameter C of approximately 2.6 millimeters, and an indent 15 extending approximately 0.65 millimeter into the cylinder. Filament 2 is a 0.13 millimeter (5-mil) tungsten wire which is centered within cathode 10 by spacers 5. In this configuration, the minimum distance D would be approximately 0.7 millimeter (0.028 inch).

The particular components and equipment discussed above are cited merely to illustrate particular embodiments of the invention. It is contemplated that the use of this invention may involve different components and shapes as long as the principle, having a filament relatively close to one portion of a cathode, is followed. For example, the cross-section of the cathode could be elliptical, with normal inside diameter C being measured across the conjugate (narrow) axis thereof. A cathode assembly so constructed will provide a strong, reliable, and easily changed source of electrons for X-ray application. It is intended that the scope of the invention be defined by the claims appended hereto.

I claim:

1. A replaceable cathode assembly for an X-ray vacuum tube, said assembly comprising:

a wire filament including a straight portion having a maximum cross-sectional diameter W;

a straight tubular cathode parallel to and surrounding only said straight portion of said filament, the normal inside cross-sectional diameter C of said cathode being at least 10W; and insulating means for rigidly fastening said filament with respect to said cathode, the minimum distance D between said filament and a first sector of said cathode being less than 0.35C-0.5W, the minimum distance between said filament and the remaining sector of said cathode being too great for said filament to cause significant release of electrons.

2. The cathode assembly of claim 1 wherein said cathode is a right cylinder having a cross-section consisting of an arc over the remaining sector of its circumference and a straight section consisting of at least one straight line over the first sector of its circumference, the minimum distance being between said filament and the straight portion.

3. The cathode assembly of claim 2 wherein the arc is generally circular.

4. The cathode assembly of claim 2 wherein the straight portion consists of one straight line.

5. The cathode assembly of claim 2 wherein the straight portion consists of two straight lines of substantially equal length, the minimum distance being between said filament and the intersection of the straight lines.

6. The cathode assembly of claim 5 wherein the angle formed by the intersection of said straight lines is within the range of 30° to 130° and said filament is located on the axis of said cathode.

7. The cathode assembly of claim 1 wherein said cathode is formed entirely of tungsten.

8. The cathode assembly of claim 7 wherein said filament is a tungsten wire having a diameter W of about 0.127 mm (5 mil), the normal diameter of said cathode C of about 2.6 mm (0.1 in.), and the minimum distance D of about 0.6 mm (0.025 in.).

9. The cathode assembly of claim 7 wherein said insulating means comprises a pair of thin ceramic spacers, each spacer having a hole for the passage of said filament and each spacer having an outer surface contacting the inside diameter of said cathode at more than one point.

10. The cathode assembly of claim 9 wherein each said spacer comprises a disk having a circumference identical to the circumference of an end of said cathode.

11. The cathode assembly of claim 1 further comprising conductive means for mounting said cathode to the tube, said means including a V-surface; and fastening means for holding said cathode against the crease of said V-surface.

12. The cathode assembly of claim 1 where said cathode is a right cylinder having a cross-section consisting of a circular arc over most of its circumference defining the remaining sector, the remainder of the circumference being arcuate and facing toward the center of the cathode to define the first sector.

* * * * *